US009943104B1

(12) United States Patent
Simon

(10) Patent No.: US 9,943,104 B1
(45) Date of Patent: Apr. 17, 2018

(54) PORTABLE STORAGE CONTAINER

(71) Applicant: FD Industries, Inc., Stanford, CA (US)

(72) Inventor: Nathan Simon, Petaluma, CA (US)

(73) Assignee: FD Industries, Inc., Stanford, CA (US)

( * ) Notice: Subject to any disclaimer, the term of this patent is extended or adjusted under 35 U.S.C. 154(b) by 0 days.

(21) Appl. No.: 15/499,812

(22) Filed: Apr. 27, 2017

(51) Int. Cl.

| | |
|---|---|
| ***B07C 7/04*** | (2006.01) |
| ***A24F 15/18*** | (2006.01) |
| ***B65D 25/04*** | (2006.01) |
| ***B65D 43/02*** | (2006.01) |
| ***B65D 85/10*** | (2006.01) |
| ***A24F 17/00*** | (2006.01) |
| ***A24B 7/04*** | (2006.01) |

(52) U.S. Cl.
CPC ..... *A24F 15/18* (2013.01); *A24B 7/04* (2013.01); *A24F 17/00* (2013.01); *B65D 25/04* (2013.01); *B65D 43/02* (2013.01); *B65D 85/10* (2013.01)

(58) Field of Classification Search
USPC ..... 206/86, 87, 88, 89, 576
See application file for complete search history.

(56) References Cited

U.S. PATENT DOCUMENTS 2,480,733 A * 8/1949 Hermani ..... B65D 47/28 220/254.9
4,307,808 A * 12/1981 Johnson ..... A47J 43/22 131/311
2011/0068026 A1* 3/2011 Fakhouri ..... A24F 9/04 206/244
2011/0293354 A1* 12/2011 Dwyer ..... A45D 34/042 401/176
2013/0199949 A1* 8/2013 Lefkovitz ..... B65D 33/2591 206/219
2016/0029691 A1* 2/2016 Ruzycky ..... A24C 5/02 241/24.1
2016/0100715 A1* 4/2016 Staiano ..... A47J 42/34 241/79
2016/0143480 A1* 5/2016 Watts ..... A47J 42/24 241/69
2016/0158107 A1* 6/2016 Dvorak ..... A61J 7/0084 241/25

* cited by examiner

*Primary Examiner* — Jacob K Ackun
(74) *Attorney, Agent, or Firm* — Sheppard Mullin Richter & Hampton

(57) ABSTRACT

According to various embodiments of the disclosed technology, disclosed is a kit for storing a substance and one or more tools for preparing the substance for recreational or medicinal use. The kit may include a body with a first end and a second end; a grinder compartment positioned next the second end of the body, where the grinder compartment is configured to rotate about the body; at least a first item compartment and a second item compartment located in the body for storing tools needed to prepare a substance for recreational or medicinal use; a storage compartment for storing the substance; and a sidewall attached to a side of the body such that the sidewall slides in an upward and downward direction.

20 Claims, 3 Drawing Sheets

PORTABLE STORAGE CONTAINER

TECHNICAL FIELD

The disclosed technology relates to portable storage containers. More specifically, the disclosed technology relates to portable storage containers for storing both legal substances and the tools needed to prepare the legal substances for recreational or medicinal use.

BACKGROUND

Legal substances, such as marijuana and tobacco, may need to be grinded and hand rolled into a cigarette before they can be enjoyed for recreational or medicinal use. To prepare the legal substance for recreational or medicinal use, a few particular tools and items are necessary to create such hand rolled cigarettes. For example, a user will require at least rolling paper, grinder, lighter, and perhaps even a few more additional tools depending on the user's taste and method of making his or her own hand rolled cigarette. However, these tools and items are often small and can easily be misplaced, which make it inconvenient or difficult for the user to prepare the legal substance quickly and easily.

As a result, there is currently a need for a portable all-in-one storage container that will not only store legal substances, but also store any essential tools or items so that a user may easily prepare the legal substance for recreational or medical use with relative ease and spontaneity.

BRIEF SUMMARY OF EMBODIMENTS

According to various embodiments of the disclosed technology, disclosed is a kit for storing a substance and one or more tools for preparing the substance for recreational or medicinal use. The kit may include a body with a first end and a second end; a grinder positioned next the second end of the body, where the grinder compartment is configured to rotate about the body; at least a first item compartment and a second item compartment located in the body for storing tools needed to prepare a substance for recreational or medicinal use; a storage compartment for storing the substance; and a sliding surface attached to a side of the body such that the sliding surface slides in an upward and downward direction.

Other features and aspects of the technology described herein will become apparent from the following detailed description, taken in conjunction with the accompanying drawings, which illustrate, by way of example, the features in accordance with embodiments of the disclosed technology. The summary is not intended to limit the scope of this disclosure.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION OF THE EMBODIMENTS

The following description is not to be taken in a limiting sense, but is made merely for the purpose of describing the general principles of the disclosed embodiments. The present embodiments address the problems described in the background while also addressing other additional problems as will be seen from the following detailed description. Numerous specific details are set forth to provide a full understanding of various aspects of the subject disclosure. It will be apparent, however, to one ordinarily skilled in the art that various aspects of the subject disclosure may be practiced without some of these specific details. In other instances, well-known structures and techniques have not been shown in detail to avoid unnecessarily obscuring the subject disclosure.

Figure 1:
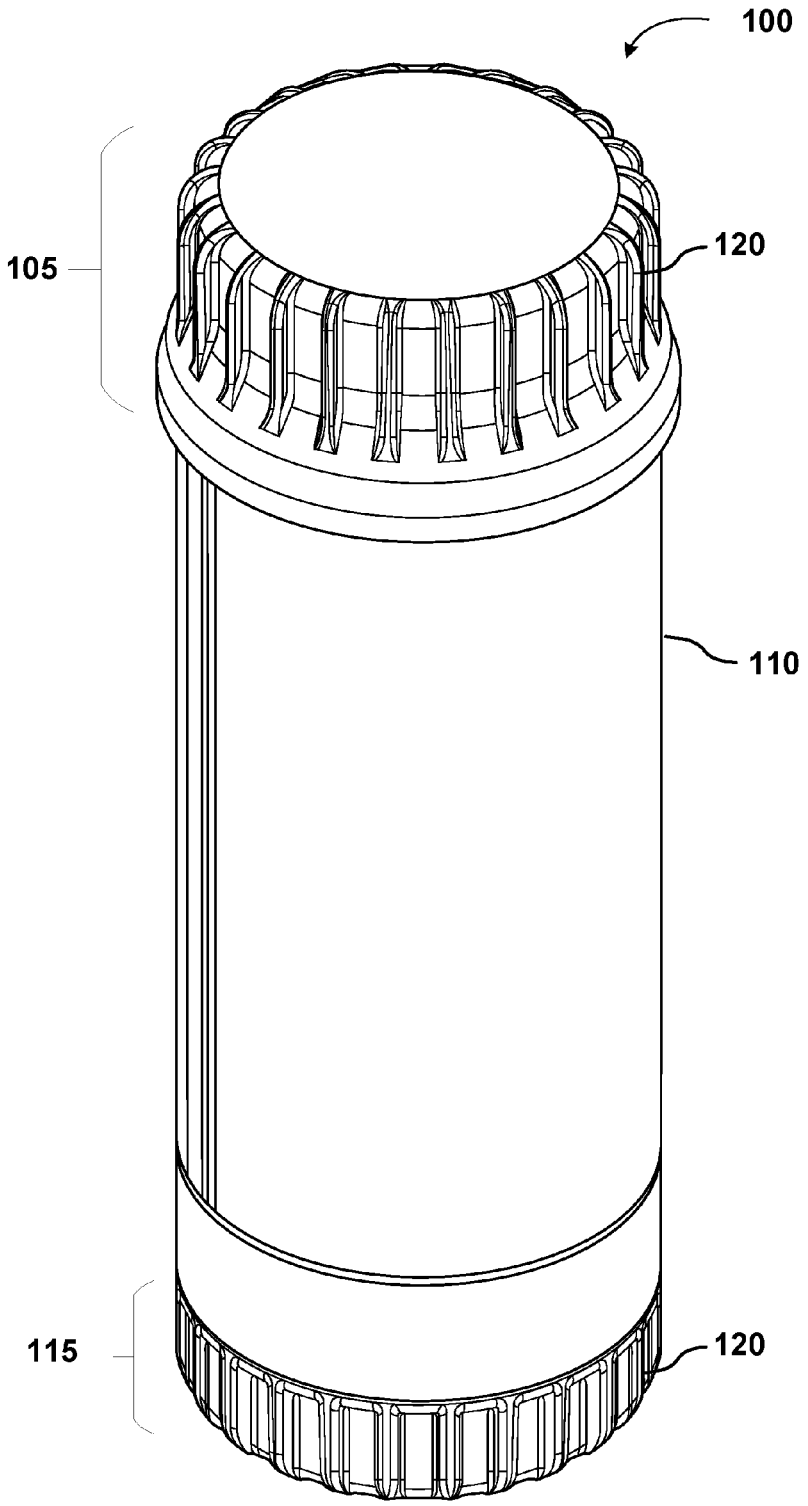
FIG. 1 illustrates portable storage container for storing and preparing legal substances for use according to one particular embodiment.

FIG. 1 illustrates portable storage container 100 for storing and preparing legal substances according to one particular embodiment. The portable storage container 100 may include a body 110 with an upper lid 105 and a lower lid 115. Additionally, both the upper lid 105 and the lower lid 115 may include a ribbed section 120. The ribbed section 120 may allow the user to have a firmer group around the upper lid 105 and lower lid 115 when attempting to remove or detach the lid away from the body 110.

As further illustrated, the body 110 may be cylindrical in shape. However, it should be noted that the body 110 can be any particular shape as would be appreciated by one of ordinary skill on the art, and thus the body 110 is not limited to an one particular shape. According to the particular shape of the body 110, the upper lid 105 and the lower lid 115 may have the same corresponding shape as the body 110.

By way of example only, the body 110 may be composed of high-grade plastic for lasting durability and hardness. In other instances, the body 110 may be composed of stainless steel. In another example, the body 110 may be composed of a mixture of both high-grade plastic and stainless steel. However, it should be noted that the body 110 may be composed of any material as would be appreciated by one of ordinary skill in the art. Additionally, the upper lid 105 and the lower lid 115 may be composed of the same or different material as the body 110.

Figure 2:
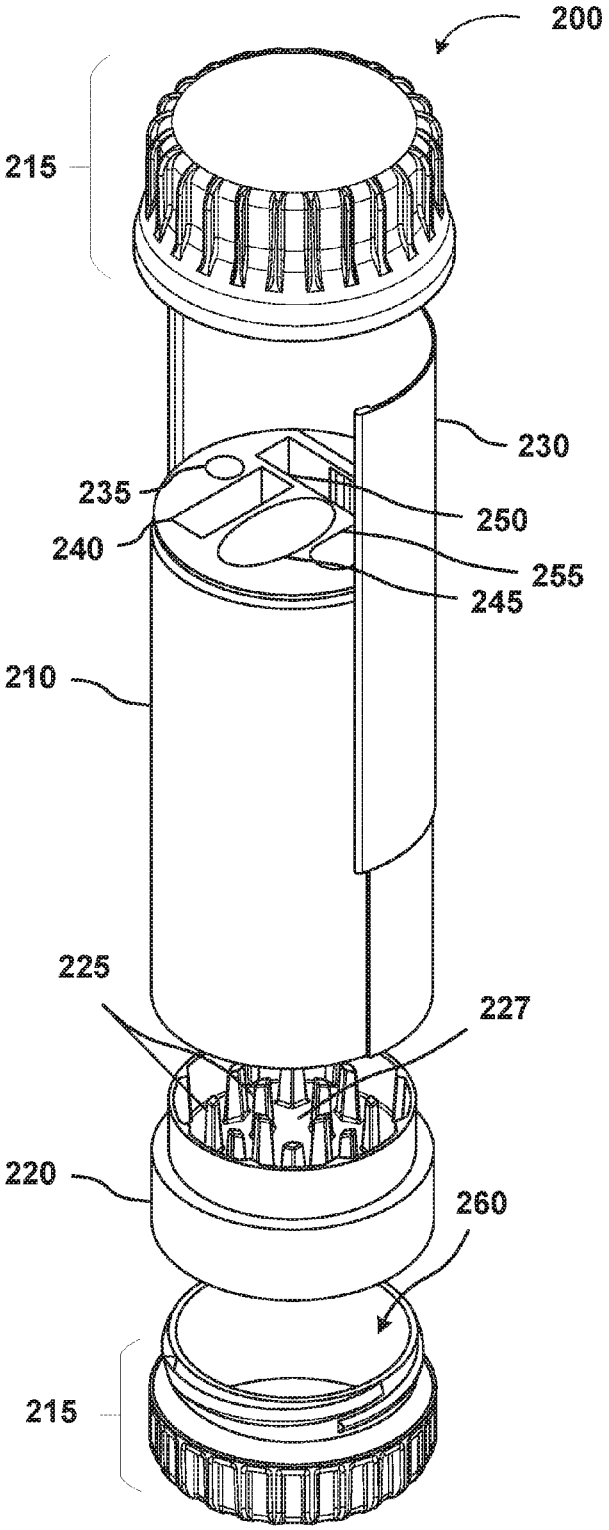
FIG. 2 illustrates an expanded view of a portable storage container for storing and preparing legal substances for use according to one particular embodiment.

FIG. 2 illustrates an expanded view of a portable storage container 200 for storing and preparing recreational drugs for use according to one particular embodiment. As illustrated, the figure depicts a body 210 with an upper lid 205 and a lower lid 215. In some embodiments, the upper lid 205 and the lower lid 215 may create a tight seal so that the recreational drugs or substances placed within the portable storage container 200 remain odorless to the outside environment.

In some embodiments, the lower cap 215 may also function as a bottom storage compartment 260 for storing the raw materials of legal substances, such as recreational and/or medicinal drugs. Such raw materials, by way of example only, may include marijuana and tobacco. The raw materials and/or other legal substances may be stored in the bottom storage compartment 260, which may then be securely and tightly sealed onto the bottom portion of the body 210. This may be achieved by twisting the lower cap 215 onto the corresponding opening portion of the body 210. In other embodiments, the bottom storage compartment 260 may include a hinge (not shown here), so that the bottom storage compartment remains hinged onto the bottom portion of the body 210. Other mechanisms for ensuring that the bottom storage compartment 260 is securely and tightly sealed onto the bottom portion of the body 210 may be utilized, such as latches, clasps, and the like.

In further embodiments, the portable storage container 200 may further include a grinder compartment 220. The grinder compartment 220 may store and grind any recreational drugs or substances that need to be grinded before using it as a recreational or medicinal drug. In some embodiments, the grinder compartment 220 may include a plurality of blades 225 or raised surfaces. In further embodiments, the grinder compartment 220 may also include mesh 227 located near the bottom of the grinder compartment 220. This mesh 227 may collect the fine particles produced from the grinding of the legal substance in the grinder compartment 220.

By way of example only, grinding the legal substances to the desired particle size may be achieved by first packing the grinder compartment 220 with the desired substance, attaching the grinder compartment 220 to the body 210, and then twisting the grinder compartment 220 about the body 210 in a clockwise or counter-clockwise motion.

In some embodiments, the body 210 may include various shaped compartments 234, 240, 245, 250 to store various items or tools a user may wish to transport and use when preparing the legal substance for recreational or medicinal use. By way of example only, the compartment labeled 235 may be configured to store a poke tool or screwdriver. However, the compartment labeled 235 may be used to store any long, slender or cylindrical shaped object, such as a toothpicks, tweezers, roach clip and the like.

Additionally, the compartment labeled 240 may be configured to store filter tips. Furthermore, the compartment labeled 245 may be configured to store a lighter and the compartment labeled 250 may be configured to store rolling papers used to create a hand rolled cigarette made from the preferred choice of legal substance. By way of example only, the compartment labeled 250 may come in various shapes and sizes to accommodate various lighters, such as torch lighters and electric lighters.

Additionally, the compartment labeled 255 may be used as an area for storing all pre-handmade cigarettes to be enjoyed for later use. However, it should be noted that these compartments 234, 240, 245, 250 may be configured to come in various shapes and sizes to accommodate various tools and items a user may need to prepare and enjoy the legal substance for recreational or medicinal use. By way of example, the compartments 234, 240, 245, 250 may further be configured to accommodate a hemp wick dispenser, an ash tray, an area to store a blunt cutter, and the like.

In some embodiments, the portable storage container 200 may include a sliding surface 230 that attaches to the side of the body 210. The sliding surface 230 may slide in an upward and downward direction. A user may wish to slide the sliding surface 230 upward when attempting to shield the flame sourced from the lighter stored in the portable storage container 200 from any wind. This then allows the user to comfortably and effectively draw a flame from the lighter regardless of the weather or environmental conditions with relative ease.

In further embodiments, the sliding surface 230 may slide to completely detach altogether from the body 210 of the portable storage container 200. The sliding surface 230 may then be utilized as a makeshift table top surface that a user may use when making a hand rolled cigarette or preparing the legal substance for recreational or medical use.

Figure 3:
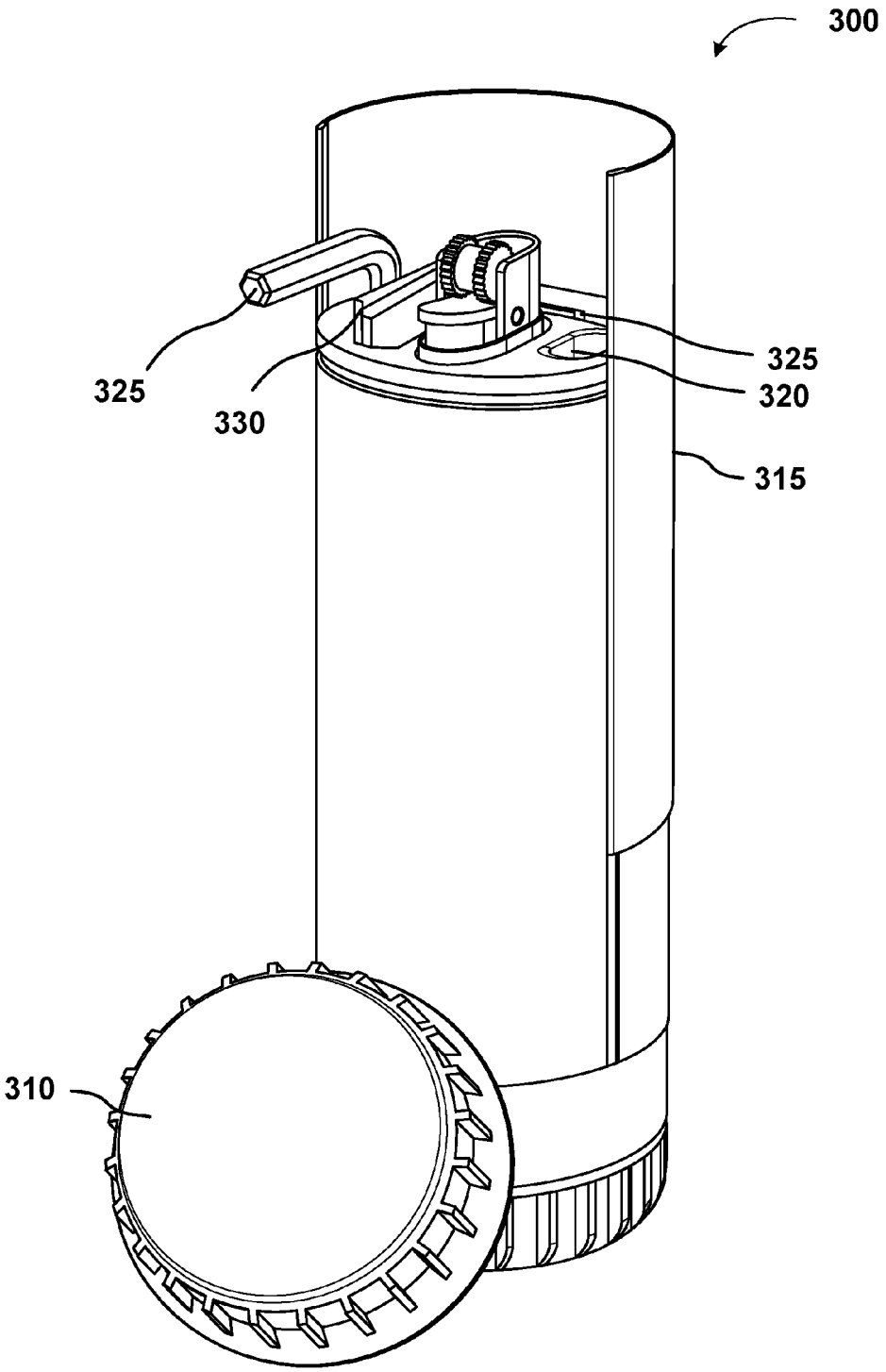
FIG. 3 is a diagram illustrates a portable storage container filled with tools and accessories for preparing legal substances for use according to certain embodiments of the provided disclosure.

FIG. 3 is a diagram illustrates a portable storage container 300 filled with accessories according to certain embodiments of the provided disclosure. As illustrated, the upper lid 310 is removed from the top portion of the portable storage container 300. This will then allow the sliding surface 315 to move upward and downward as directed by the user. Here, the sliding surface 315 is raised upward, which may function as a shield to protect the flame from the lighter from being potentially blown out by the wind. Because the lighter 335 is accessible without having to remove it from its compartment, the user may draw a flame from the lighter 335 while holding the portable storage container 300 in his or her hands.

FIG. 3 further features the items that can be placed and stored within the portable storage container 300 as discussed in FIG. 2. As illustrated here, the portable storage container 300 may store a poke tool 325, filter tips 330, lighter 335, rolling papers 320, and a container 320 for storing already pre-made cigarettes. However as discussed above, any wide variety of tools may be stored in the portable storage container 300 and is not limited to the examples listed.

Various embodiments have been described with reference to specific example features thereof. It will, however, be evident that various modifications and changes may be made thereto without departing from the broader spirit and scope of the various embodiments as set forth in the appended claims. The specification and figures are, accordingly, to be regarded in an illustrative rather than a restrictive sense.

Although described above in terms of various example embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the present application, whether or not such embodiments are described and whether or not such features are presented as being a part of a described embodiment. Thus, the breadth and scope of the present application should not be limited by any of the above-described example embodiments.

Terms and phrases used in the present application, and variations thereof, unless otherwise expressly stated, should be construed as open ended as opposed to limiting. As examples of the foregoing: the term "including" should be read as meaning "including, without limitation" or the like; the term "example" is used to provide illustrative instances of the item in discussion, not an exhaustive or limiting list thereof; the terms "a" or "an" should be read as meaning "at least one," "one or more" or the like; and adjectives such as "conventional," "traditional," "normal," "standard,"

"known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed in multiple groupings or packages or across multiple locations.

Additionally, the various embodiments set forth herein are described in terms of example block diagrams, flow charts, and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A portable storage container comprising:

a body with a first end and a second end;

a grinder compartment positioned next the second end of the body, where the grinder compartment is configured to rotate about the body;

at least a first item compartment and a second item compartment located in the body for storing tools needed to prepare a substance for recreational or medicinal use; and a sliding surface attached to a side of the body such that the sliding surface slides in an upward direction to shield a flame sourced from a lighter from weather conditions and a downward direction.

2. The portable storage container of claim 1, wherein the grinder compartment comprises a plurality of raised surfaces and a mesh near a floor of the grinder compartment.

3. The portable storage container of claim 1, wherein the first item compartment is configured to store a poke tool or a screwdriver.

4. The portable storage container of claim 3, wherein the second item compartment is configured to store a filter tip for using in a hand rolled cigarette.

5. The portable storage container of claim 4, further comprising a third item compartment configured to store a lighter.

6. The portable storage container of claim 5, further comprising a fourth item compartment configured to store rolling papers.

7. The portable storage container of claim 6, further comprising a fifth item compartment configured to store cigarettes.

8. The portable storage container of claim 1, further comprising a storage compartment for storing substances, wherein the storage compartment is placed beneath the grinder compartment.

9. The portable storage container of claim 1, wherein the body is made of material comprising stainless steel or hardened plastic.

10. The portable storage container of claim 1, further comprising an upper lid to be attached onto the first end of the body and the lower lid to be attached onto the second end of the body.

11. The portable storage container of claim 10, wherein the sliding surface is configured to slide away and detach completely from the body.

12. A kit for storing a substance and one or more tools for preparing the substance for use comprising:

a body with a first end and a second end;

a grinder compartment positioned next the second end of the body, where the grinder compartment is configured to rotate about the body;

at least a first item compartment configured to store a lighter and a second item compartment located configured to store rolling paper;

and a storage compartment for storing substances; and a sliding surface attached to a side of the body such that the sliding surface slides in an upward direction to shield a flame sourced from a lighter from weather conditions and a downward direction.

13. The kit of claim 11, wherein the grinder compartment comprises a plurality of raised surfaces and a mesh near a floor of the grinder compartment.

14. The kit of claim 13, further comprising a third item compartment configured to store a poke tool or a screwdriver.

15. The kit of claim 14, further comprising a fourth item compartment configured to store a filter tip.

16. The kit of claim 11, wherein the body is made of material comprising stainless steel or hardened plastic.

17. The kit of claim 11, wherein the sliding surface is configured to slide away and detach completely from the body.

18. The kit of claim 11, wherein the storage compartment is placed beneath the grinder compartment.

19. The kit of claim 18, wherein the grinder comprises a mesh near a floor of the grinder compartment.

20. The kit of claim 11, further comprising an upper lid to be attached onto the first end of the body and the lower lid to be attached onto the second end of the body.

* * * * *